US010865662B2

(12) United States Patent
Stretch

(10) Patent No.: US 10,865,662 B2
(45) Date of Patent: Dec. 15, 2020

(54) ANTI-ROTATION FEATURE FOR FOLLOWERS USING AN OIL GALLERY INSERT

(71) Applicant: Eaton Intelligent Power Limited, Dublin (IE)

(72) Inventor: Dale Arden Stretch, Novi, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/099,552

(22) PCT Filed: May 5, 2017

(86) PCT No.: PCT/US2017/031300
§ 371 (c)(1),
(2) Date: Nov. 7, 2018

(87) PCT Pub. No.: WO2017/196665
PCT Pub. Date: Nov. 16, 2017

(65) Prior Publication Data

US 2019/0153905 A1 May 23, 2019

Related U.S. Application Data

(60) Provisional application No. 62/333,215, filed on May 7, 2016.

(51) Int. Cl.

| | |
|---|---|
| ***F01L 1/14*** | (2006.01) |
| ***F01L 1/04*** | (2006.01) |
| ***F01L 1/245*** | (2006.01) |
| ***F01L 1/24*** | (2006.01) |

(52) U.S. Cl.
CPC ..... *F01L 1/04* (2013.01); *F01L 1/14* (2013.01); *F01L 1/146* (2013.01); *F01L 1/245* (2013.01);
(Continued)

(58) Field of Classification Search
CPC ... F01L 1/04; F01L 1/146; F01L 1/245; F01L 1/14; F01L 2107/00; F01L 2001/256;
(Continued)

(56) References Cited

U.S. PATENT DOCUMENTS 4,729,349 A 3/1988 Sonoda et al.
5,022,356 A 6/1991 Morel, Jr. et al.
(Continued)

FOREIGN PATENT DOCUMENTS

FR 2948966 A1 2/2011
JP S62 162310 U 10/1987
(Continued)

OTHER PUBLICATIONS

International Search Report and Written Opinion dated Aug. 17, 2017 for PCT/US2017/031300; pp. 1-10.
(Continued)

*Primary Examiner* — Zelalem Eshete
(74) *Attorney, Agent, or Firm* — Mei & Mark, LLP

(57) ABSTRACT

An engine comprises a plurality of rotating eccentric cams on a cam rail, a valve train mechanism, and respective followers wherein at least one of the respective followers has a respective first end in contact with a respective rotating eccentric cam and a respective second end in contact with the valve train mechanism, a body extending between the first end and the second end, and a follower fluid port. The engine further comprises an oil gallery bore parallel to the cam rail wherein the oil gallery bore is configured to supply oil to the respective follower through its fluid port. The engine further comprises a gallery insert placed in the oil gallery bore and is configured to abut the respective follower to prevent axial rotation with respect to the cam rail. The engine further comprises a gallery insert abut a flat surface of a follower to prevent axial rotation.

17 Claims, 6 Drawing Sheets

(52) U.S. Cl.
CPC ..... *F01L 1/2422* (2013.01); *F01L 2001/256* (2013.01); *F01L 2305/00* (2020.05); *F01L 2307/00* (2020.05)

(58) Field of Classification Search
CPC ..... F01L 2105/00; F01L 2305/00; F01L 2307/00; F01L 1/2422
See application file for complete search history.

(56) References Cited

U.S. PATENT DOCUMENTS

| | | | |
|---|---|---|---|
| 6,513,472 | B2 | 2/2003 | Speil et al. |
| 7,007,651 | B2 | 3/2006 | Spath et al. |
| 7,121,244 | B2 | 10/2006 | Roe et al. |
| 9,051,854 | B1 | 6/2015 | Cyborski |
| 9,624,794 | B2 | 4/2017 | Shewell |
| 2002/0121255 | A1 | 9/2002 | Speil et al. |
| 2004/0194739 | A1 | 10/2004 | Roe et al. |
| 2016/0040563 | A1 | 2/2016 | Shewell |
| 2016/0319708 | A1 | 11/2016 | Nielsen |

FOREIGN PATENT DOCUMENTS

| | | | |
|---|---|---|---|
| JP | S64 13210 | U | 1/1989 |
| JP | H02 144601 | U | 12/1990 |
| JP | 2010-001884 | A | 1/2010 |

OTHER PUBLICATIONS

Supplementary European Search Report for PCT/US2017/031300, dated Oct. 11, 2019; pp. 1-7.

ANTI-ROTATION FEATURE FOR FOLLOWERS USING AN OIL GALLERY INSERT

This is a National Stage Entry under § 371 of PCT/US2017/031300 filed May 5, 2017 and claims the benefit of U.S. Provisional Application No. 62/333,215, filed May 7, 2016, all of which are incorporated herein by reference.

TECHNICAL FIELD

This application relates to an anti-rotation feature for an engine cam follower by use of a gallery insert, placed inside an oil gallery passage, which abuts the follower body to prevent axial rotation.

BACKGROUND

Internal combustion engines can have followers, also called cam followers, lifters, or tappets, to eliminate mechanical clearance required in an engine valve train during thermal expansion. Followers are placed near the cam rail to follow the profile of a cam lobe and to lift one or more engine valves. Hydraulic followers provide several improvements over solid mechanical followers by minimizing periodic adjustments and service for valve train maintenance in addition to reduction in valve train noise.

Followers can integrate hydraulic lash adjusters and other valve lash adjusters. Followers can have a flat-bottom design and be called a flat-tappet, and followers can have a roller-tappet design and be called roller lifters. However, followers cannot rotate in their bore. A follower failure is catastrophic to engine operation.

SUMMARY

The invention disclosed herein overcomes the above disadvantages and improves the art by way of an anti-rotation feature for a follower comprising a gallery insert placed in the follower oil gallery.

An engine comprising a cam rail comprising a rotating eccentric cam, a valve train mechanism configured to open and close a fluid pathway of a combustion cylinder, a follower, and an oil gallery bore, parallel to the cam rail, configured to supply fluid to the follower through a follower fluid port. The follower further comprising a first end in contact with the rotating eccentric cam, a second end in contact with a portion of the valve train mechanism, and a body extending between the first end and the second end, and a fluid port. The engine further comprising a gallery insert in the oil gallery bore, wherein the gallery insert is configured to abut the follower body to prevent rotation of the follower with respect to the cam rail.

An engine comprising a plurality of rotating eccentric cams, a valve train mechanism configured to open and close a fluid pathway of a combustion cylinder, and respective followers. The followers having respective first ends in contact with respective ones of the rotating eccentric cams, respective second ends in contact with the respective valve train mechanisms, each of the respective followers having a body extending between the first end and the second end, and each of the respective followers comprising a respective follower fluid port. The engine further comprising an oil gallery bore parallel to the cam rail wherein the oil gallery bore is configured to supply fluid to the respective follower fluid ports. The engine further comprising a gallery insert in the oil gallery bore wherein the gallery insert is configured to abut the respective followers to prevent rotation of the respective followers with respect to the cam rail. The engine further comprising hydraulic followers with either a flat-tappet design or a roller-tappet design.

An engine comprising a gallery insert placed inside the oil gallery bore, the gallery insert comprising a perforated structure. The gallery insert can comprise one of a rectangular structure, a C-shaped structure, or a triangular structure, each having an axial dimension configured to slide through the oil gallery bore. The gallery inserts can comprise through holes to maintain oil flow in to the followers. The oil gallery bore can further comprise an orientation key hole. A keyed cap can interface with the gallery insert and the orientation key hole to fix the orientation of the gallery insert with respect to the oil gallery bore.

An engine can comprise a gallery insert inside an oil gallery. The gallery insert abuts a flat surface of a follower body to prevent axial rotation of the follower with respect to the cam rail.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

BRIEF DESCRIPTION OF THE DRAWINGS

The accompanying drawings, which are incorporated in and constitute a part of this specification, illustrate several explanations of the methods and apparatus disclosed herein.

DETAILED DESCRIPTION

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures. This disclosure primarily focusses on a V-type combustion engine, but tenets of the disclosure can be applied to other engines layouts where an engine component requires non-rotating alignment with a fluid duct. The tenets apply to engine systems fueled by biofuels and other petroleum products such as gasoline, diesels and including hybrid-electric vehicles. Heavy-duty, light-duty, and medium-duty vehicles can benefit from the techniques disclosed herein.

The disclosed apparatus and systems have broad applicability to many types and configurations of followers in various valve train arrangements in an engine. Followers can also be referred to as valve lash adjusters, cam followers, lifters, and tappets.

Figure 2A:
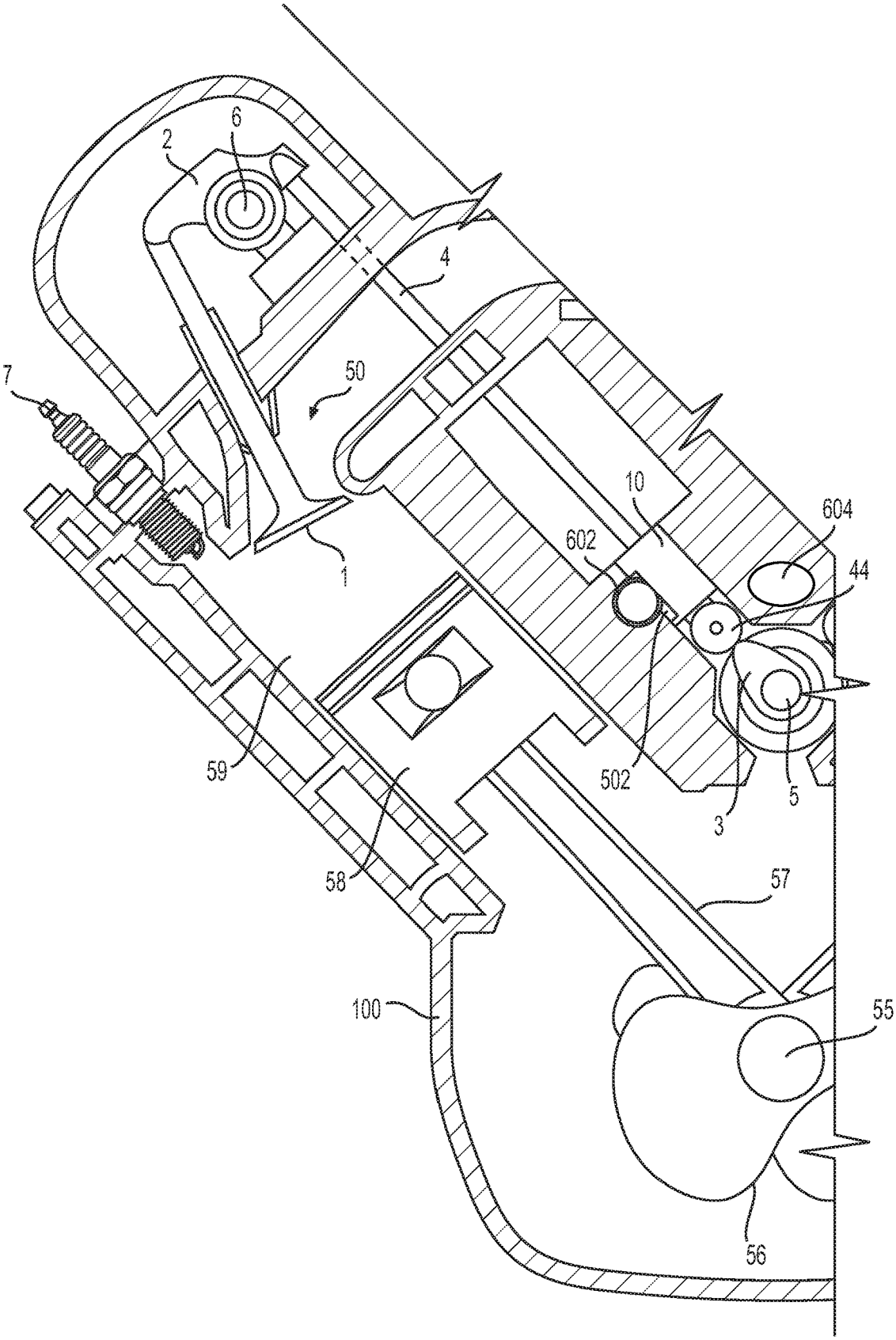
FIGS. 2A-2C show portions of an engine block with respect to the oil gallery, the gallery insert, and a cam follower.

FIG. 2A, shows an example of a cam-in-block arrangement of an internal combustion engine. In this arrangement, the engine uses a combination of a rotating eccentric cam comprising cam lobe 3, a follower 10, a pushrod 4, and a rocker arm 2 to operate a valve 1. The valve can be an intake valve or an exhaust valve. Alternative valve train arrangements can include a variety of configurations with differences in size, placement, and actuation, of the valve train elements. For example, the follower 10 can be configured to push directly on the rocker arm 2 and to omit the pushrod 4. The follower 10 is shown to engage with the cam lobe 3 on a cam rail 5 and to reciprocate in a bore 110 in response to cam rail 5 rotation. In turn, the reciprocating movement of the follower 10 is transferred through the push rod 4 and rocker arm 2 which pivots via the pivot point 6 to operate valve 1. In this manner, valve 1 can open and close a fluid pathway 50 of a combustion cylinder 59 in engine block 100. The engine block 100 comprises a fuel injector 7, a reciprocating piston 58, a piston rod 57, and rotating crankshaft 55 with counter weight 56.

Figure 1:
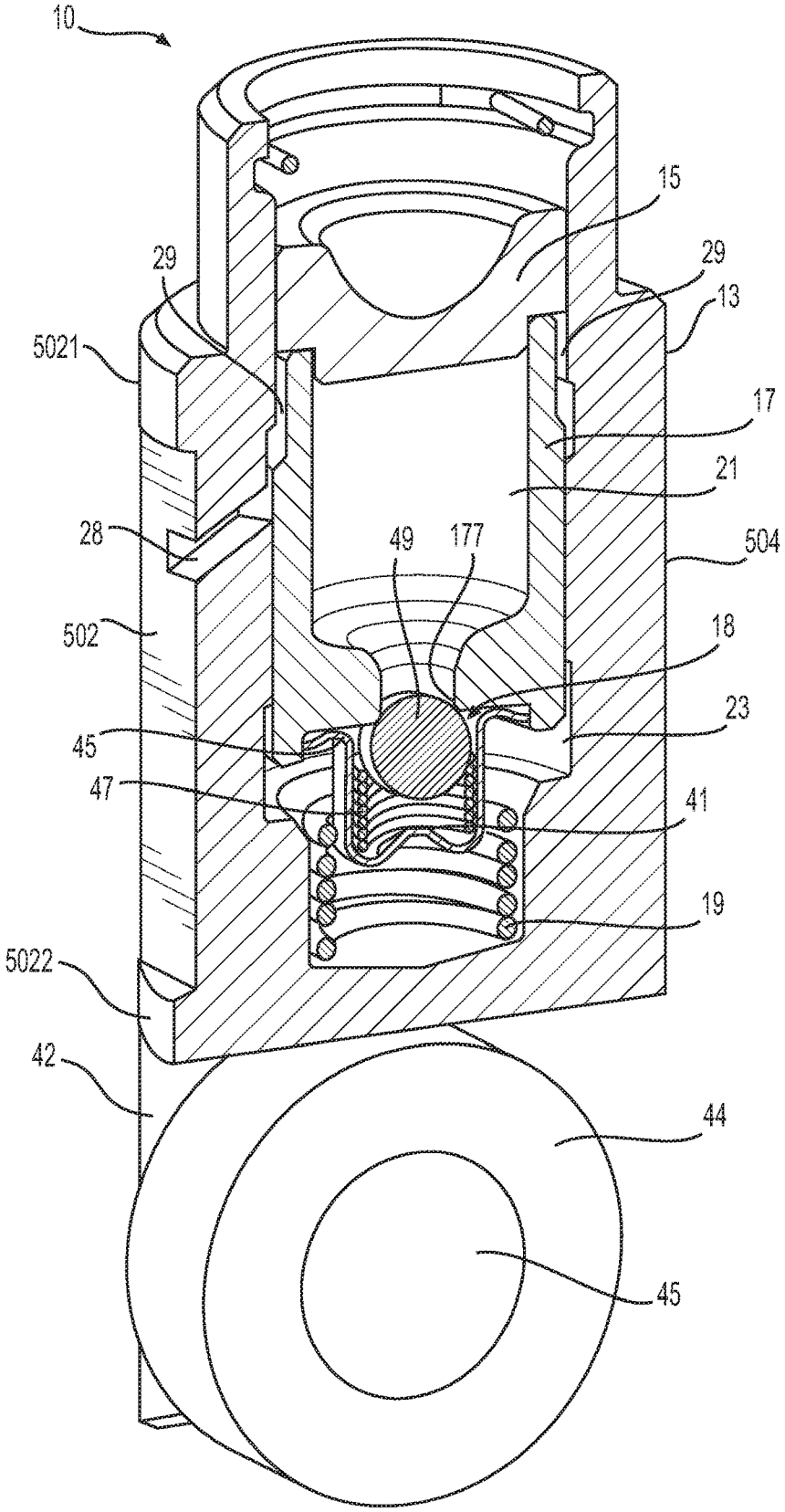
FIG. 1 illustrates an example of a follower.

FIG. 1 is an example of a hydraulic follower comprising a roller-tappet design. A flat-tappet design is also contemplated for use with this disclosure, and can be accomplished as by omitting roller 44 and mounting arm 42. A housing or body 13 comprises an interior axial pocket for circulating hydraulic fluid and for receiving a normally-biased closed check ball assembly 18, first fluid chamber 21, and plunger 17 with plunger spring 19. The body 13 moves in conjunction with the cam lobe 3, while the plunger 17 and first fluid chamber 21 move along with the push rod 4 seated in plunger cap 15. Plunger cap 15 can comprise a second end of the follower 10 for contacting the valve train mechanisms. Riding in between the plunger 17 and the second fluid chamber 23 is the check ball assembly 18. A check element can be a seal such as a plate or check ball 49, for example. Check ball 49 is held in a retainer 45 (also referred to as a cage) and pressed against a shoulder 177 of plunger 17 by a ball compression spring 47. In this normally-biased closed state, fluid cannot pass between the first fluid chamber 21 and the second fluid chamber 23 when the device is in a neutral state, but in operation, fluid pressure can assist the check ball 49 in overcoming the spring force of the compression spring 47 such that the check ball 49 rests against the inner seat surface 41. In this latter state, fluid can pass between the first fluid chamber 21 and the second fluid chamber 23.

Other followers can be used, and the disclosure is compatible with other hydraulic devices. For example, closed-biased followers, open-bias followers, "free ball" type followers, and dual feed port followers can be used herein.

Hydraulic follower 10 can be pressurized by oil fed through the oil gallery 602 to remove whatever clearance there is in the valve train in a known manner. Oil is fed to a follower fluid port 28 on the body 13. Pressurized fluid can enter the first fluid chamber 21 through a plunger fluid port 29 formed by gaps. Additional leakdown paths, drilling or notches can be included. Cam lobe 3 can push on the body 13 to open the valve 1. The check ball 49 can unseat from shoulder 177 in a known manner. This unseating opens fluid communication between first fluid chamber 21 and second fluid chamber 23. The seating and unseating of the check ball 49 along with motion of plunger 17 and body 13, can take up lash in the system in a known manner.

Based on an engine operation state or stroke, the plunger 17 can be in an upward or downward position such that the body fluid port 28 comes in or out of alignment with the plunger fluid port 29, and the plunger spring 19 either pushes the plunger 17 upward or the plunger spring 19 is compressed by affiliated cam lobe 3 and or rocker arm 2 operation.

Plunger 17 can have a circumferential groove to allow the plunger fluid port 29 to maintain fluid communication with body fluid port 28, or the inner diameter of the body 13 can have a circumferential groove to maintain fluid communication between body fluid port 28 and plunger fluid port 29 regardless of whether the plunger 17 is in its top-biased or bottomed-out position.

Roller 44 can comprise a first end of the follower 10 for contacting and rotating against the cam lobe 3 thereby minimizing friction between the cam lobe 3 and the follower 10. The orientation of the follower 10 must be controlled to keep the follower 10 from rotating with respect to the cam lobe 3.

Figure 3:
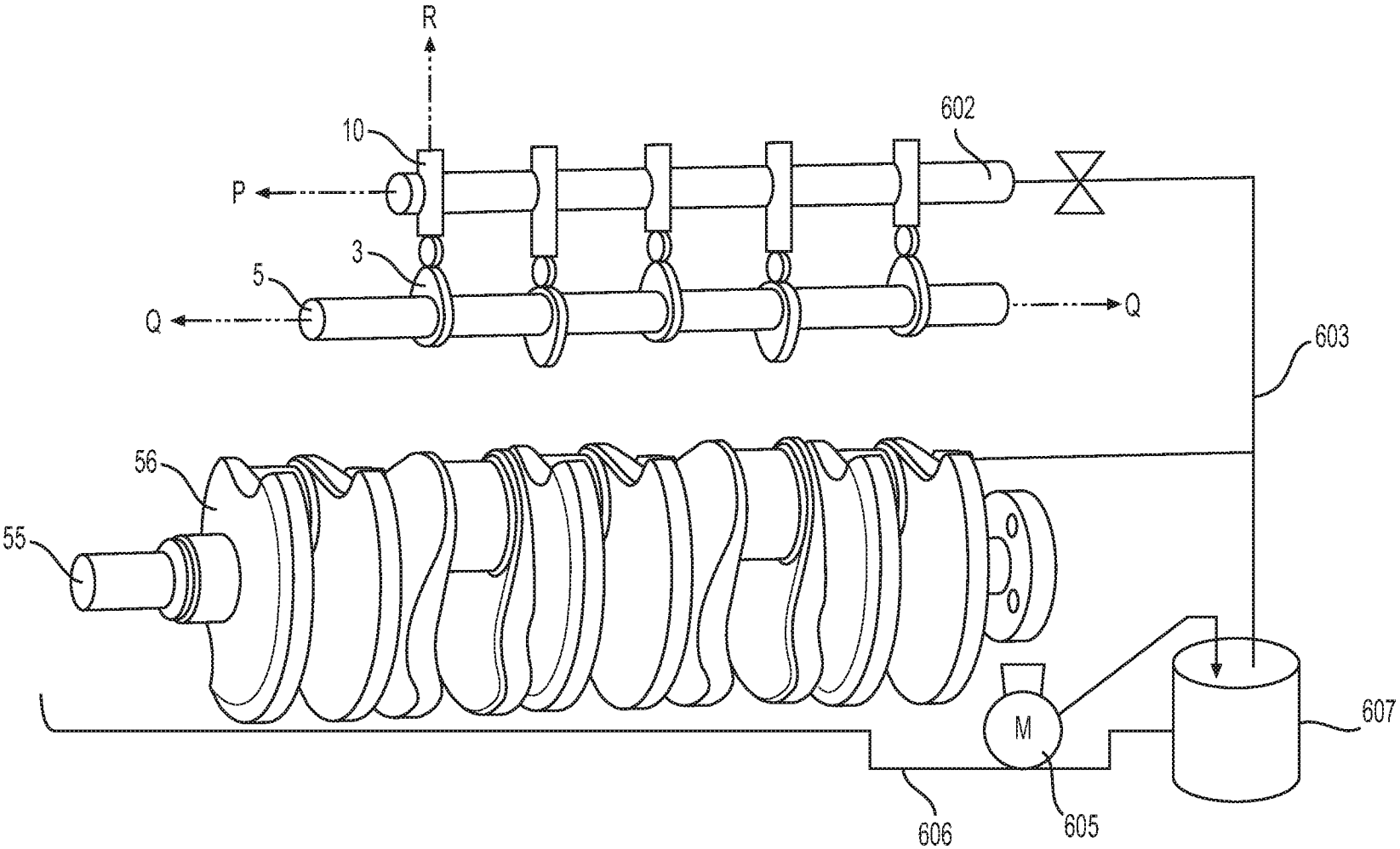
FIG. 3 is a schematic example of an engine lubrication system illustrating oil galleries feeding to the cam rail and cam followers.

FIG. 3 illustrates one example of an engine lubrication system. Engine oil in the oil pan 606 is distributed through the engine's various metal-to-metal surfaces via a motorized pump 605. An optional filter 607 transfers oil to oil path 603. Oil is then divided into various galleries or ducts. Oil can be fed to crankshaft 55 and cam rail 5 to lubricate them. Oil can also be fed to oil gallery 602 that feeds oil to the followers 10. In a V-style engine of the example, the oil gallery 602 and followers 10 are repeated on each side of the engine block 100. With five followers 10 illustrated, it is understood that there are 10 cylinders affiliated with this engine, but the invention is not so restricted, and the aspects of this disclosure can be used with any number of cylinders requiring anti-rotation benefits of a hydraulically fed part. Valves and other control mechanisms can be included and controlled as necessary.

Figure 2B:
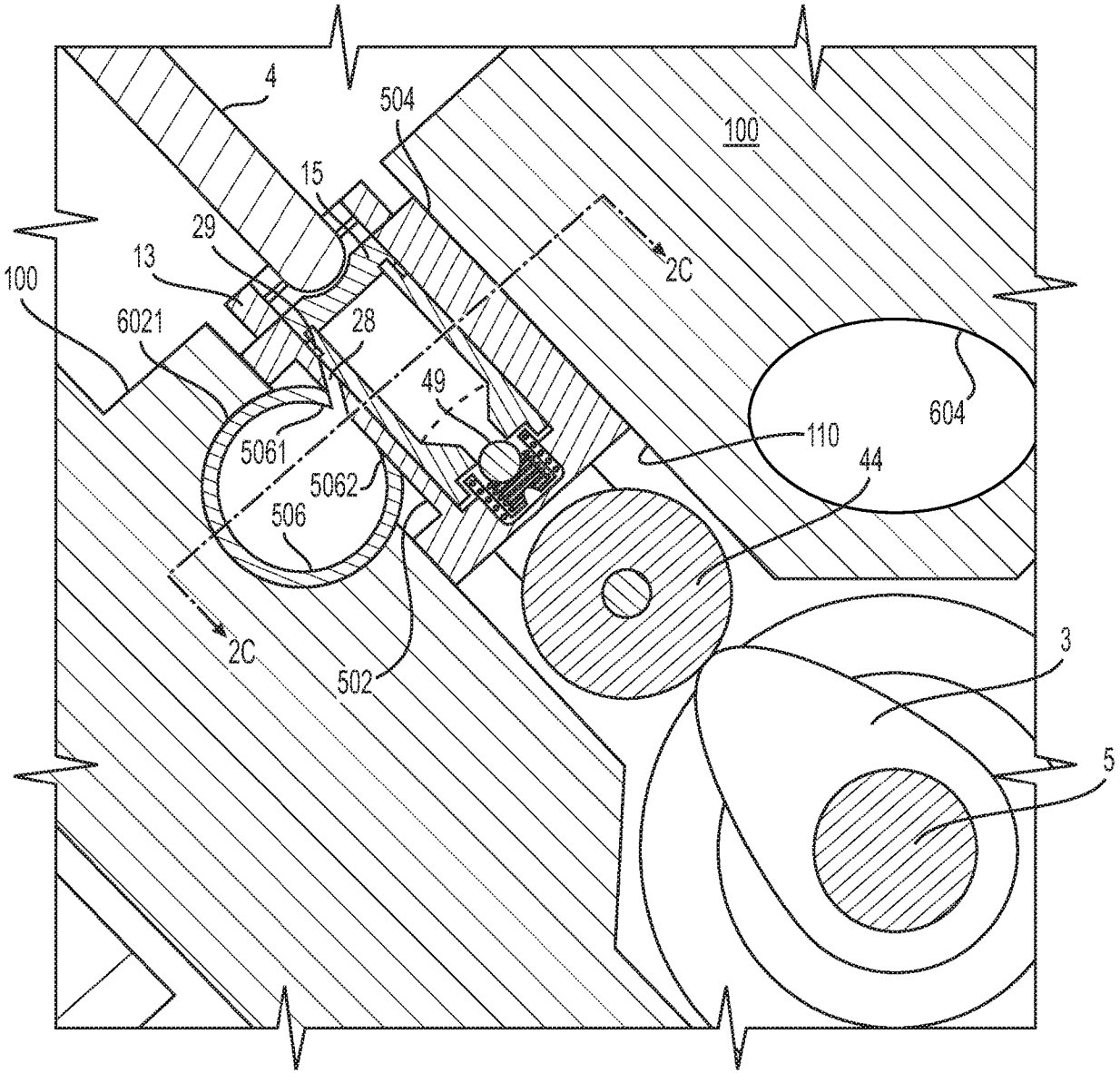
Figure 2C:
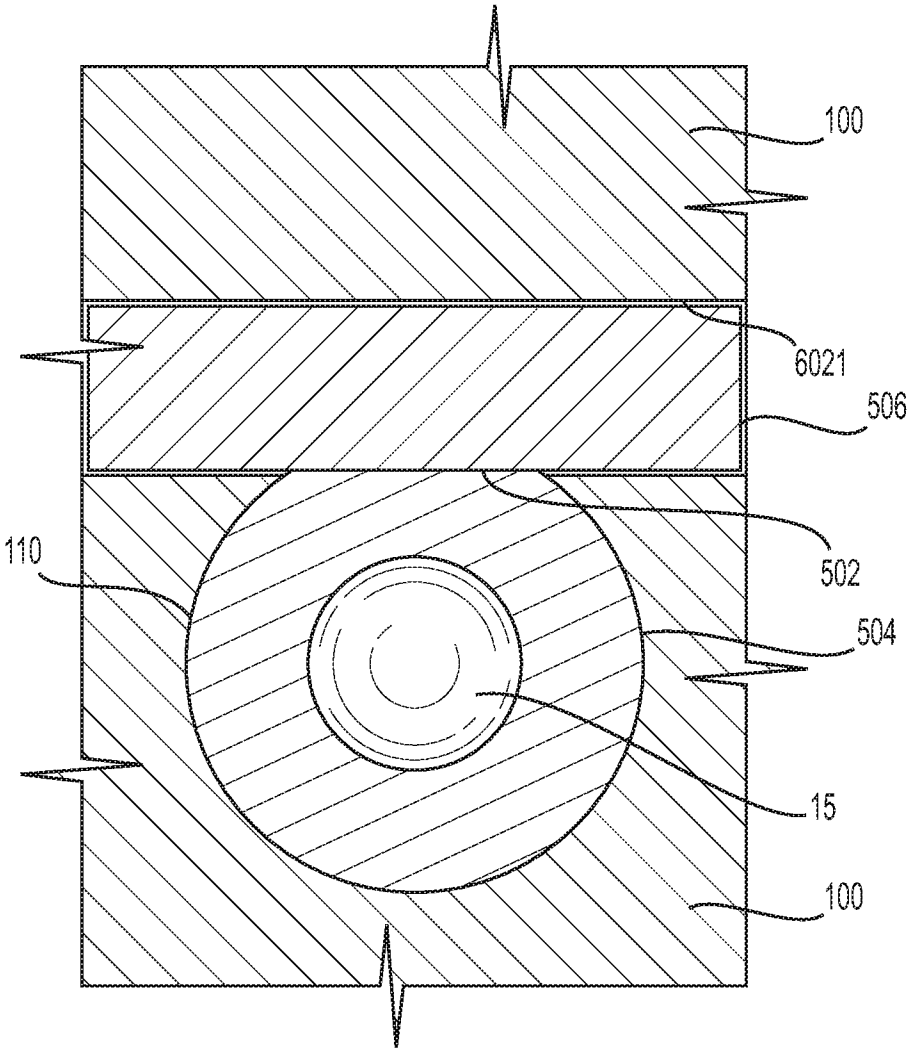

FIGS. 2A-2C depict cross sections of the engine block 100 illustrating a roller follower 10 with one side of its body 13 aligned next to the follower oil gallery 602. An eccentric cam lobe 3 rotates around a cam rail 5 to push the roller 44 on the bottom end of the follower body 13. As the cam lobe 3 rotates, the follower body 13 is moved up and down transferring the reciprocating motion to the pushrod 4 and the rest of the valve train mechanism. Valve train mechanisms can comprise those mechanisms necessary to open and close the engine valves 1 of a combustion cylinder 59, and can comprise at least a pushrod 4 or at least a rocker arm 2. A fluid port 28 through the follower body 13 allows transfer of oil from the oil gallery 602 to the plunger fluid port 29 and into the plunger 17.

To accomplish hydraulic actuation of the follower 10, the roller 44 is in contact with the cam rail 5 through the cam lobes 3. Or, a flat-bottom tappet is in contact with the cam rail 5 through the cam lobes 3. The follower 10 centerline can be along follower axis R, which has to run perpendicular with the cam rail centerline along cam rail axis Q without rotation. Otherwise, if the follower 10 rotates, it will interfere with the cam rail rotation.

It is possible to maintain follower 10 along follower axis R perpendicular with the cam rail axis Q by using a gallery insert along an oil gallery axis P. A first gallery insert 506 can have a first end 5061 that extends out from the oil gallery abutting the respective followers 10 to prevent rotation of the followers with respect to the cam rail. A surface of the gallery insert 506 can abut the internal surface of the oil gallery bore 6021. In this manner, the gallery insert 506 abuts the follower body 13 to prevent the latter from rotating about its follower axis R with respect to the cam rail axis Q.

In FIG. 2B, first gallery insert 506 comprises a "C" shape. First end 5061 and a second end 5062 abut a flat surface 502 in follower 10. The flat surface 502 slides along the oil gallery insert 506 as the follower 10 rises up and down. The exterior 504 of the follower 10 rides against bore 110 in engine block 100. A small amount of fluid can lubricate the motion via a purposeful leakage between bore 110 and follower 10. A seal or other structure can optionally be placed at the top or bottom of the bore 110 to contain fluid or to contain the follower motion. The flat surface 502 can be bounded by a first sealing land 5021 and a second sealing land 5022 that is formed in the exterior of follower body 13. Sealing lands 5021, 5022 can be formed, for example, by machining the flat surface 502 in to the body 13. Alternatively, seals can be seated in glands to form sealing lands 5021, 5022. Sealing lands restrict leakage from the bore 110.

Figure 4A:
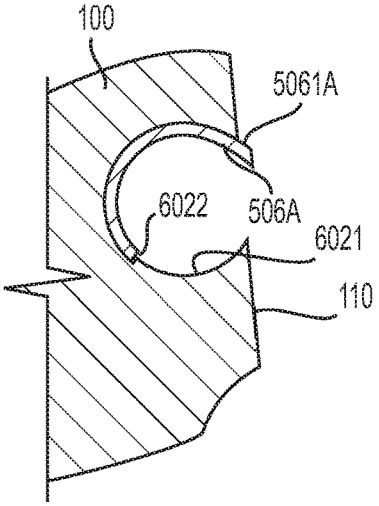
FIGS. 4A-4C provide examples of alternative gallery inserts in alternative oil galleries.
Figure 5A:
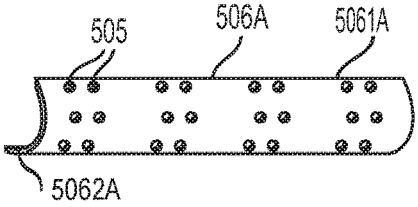
FIGS. 5A-5C provide examples of perforated gallery inserts.

Turning now to FIGS. 4A-5C, a variety of oil gallery configurations and oil gallery insert configurations are provided as possible alternatives. In FIG. 2B, the internal surface of the oil gallery bore 6021 is also "C" shaped, and complements the shape of the first gallery insert 506. First gallery insert 506 can be a sheet material that is formed or warped to conform to the internal surface of the oil gallery bore 6021. Internal surface of the oil gallery bore 6021 is smooth and formed as by a casting or boring operation. In FIG. 4A, the "C" shaped gallery insert 506A is truncated versus the "C" shaped insert of FIG. 2B. Oil gallery bore 6021 comprises a C-shaped recess. Gallery insert 506A has a first end 5061A that projects out of the oil gallery bore to contact follower 10. Oil gallery bore additionally comprises a "C" shaped positioning notch 6022 to position the second end 5062A of gallery insert 506A. Perforations 505 are shown in FIG. 5A for permitting oil gallery fluid to traverse the gallery insert 506A. Perforations in this example can be restricted to first end 5061A. A pattern to the perforations 505 indicates that they are placed at intervals corresponding to follower locations in the engine block 100.

Figure 4B:
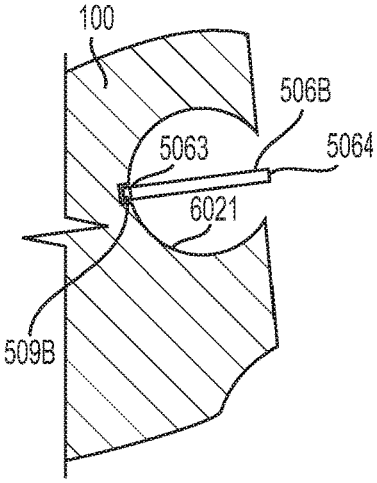
Figure 5B:
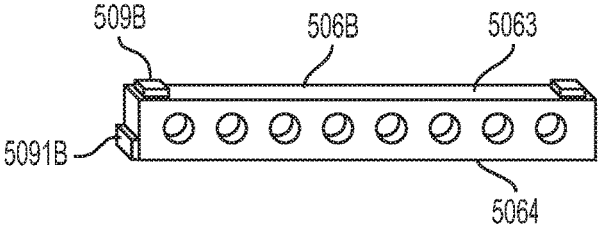

FIGS. 4B and 5B depict a gallery insert 506B that has a rectangular sheet structure. Here the perforations 505 are evenly distributed. A first end 5064 can abut the follower 10 to prevent rotation thereof. The internal surface of oil gallery bore 6021 comprises a rectangular positioning notch 6023 for receiving a key structure 509B, such as a tab, or for receiving a second end 5063 of the rectangular sheet structure. The positioning notch 6023 can span the length of the oil gallery bore 6021. Or, the positioning notch 6023 can be present at a single end of the oil gallery bore 6021 for a keyed relationship with the gallery insert 506B. A complementing key 509B can be included on the gallery insert 506B to mate with the positioning notch 6023.

Additionally, the gallery insert 506B can comprise a keyed structure in the form of a projection 5091B at one end. It is possible to position the gallery insert 506B in the oil gallery bore 6021, then place a cap to seal the oil gallery 602. The cap can be keyed or un-keyed to mate with projection 5091B or key structure 509B. Projection 5091B and key structure 509B can be included on the other examples of gallery inserts.

Figure 4C:
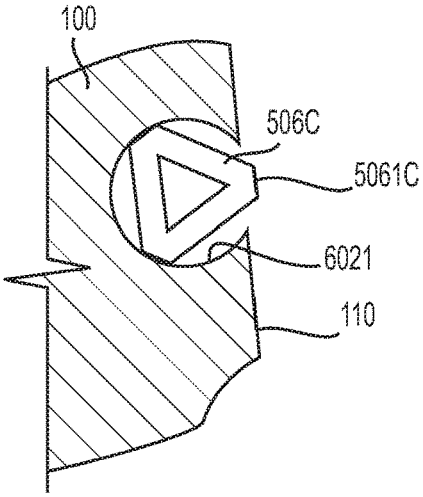
Figure 5C:
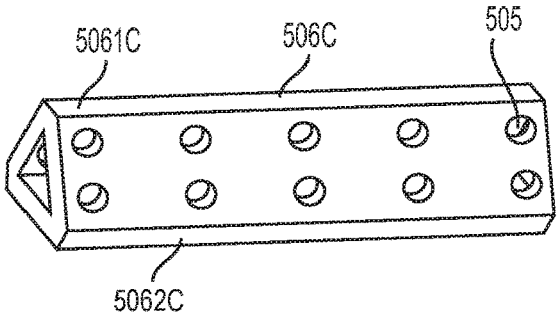

FIGS. 4C and 5C show an oil gallery bore 6021 with a gallery insert 506C that has a triangular tube structure. The tips of the triangle are squared off to resemble corners, and three flat edges are formed thereby. Perforations 505 are again included. A first end 5061C of the gallery insert 506C comprises a surface that abuts the respective followers 10 to prevent rotation. The remaining second and third edges of the other tips of the triangular gallery insert 506C can correspond to a second end 5062C to abut the internal surface of the oil gallery bore 6021.

Perforations 505 can be other sizes and other shapes than circular, such as squares or other polygonal shapes. The perforations can comprise notches or slits. First ends 5061, 5061A, 5061C, 5064 only can comprise perforations, or the perforations can be distributed according to a flow distribution pattern.

Assembling the gallery inserts 506, 506A, 506B, 506C can comprise inserting the followers 10 in to their respective bores 110 in the engine block 100. The gallery insert can be inserted in to the oil gallery bore 6021 to abut the internal surface thereof, as described above. It can be necessary to further align the followers 10 while inserting the gallery insert. The gallery inserts can be aligned with the flat surfaces 502 of the followers and can be further aligned with key features, such as notches 6022 & 6023, keys 509B, or projections 5091B. The assembly method can further comprise placing a mating cap over the end of the oil gallery bore 6021.

It is possible to assemble the gallery insert within the oil gallery bore 6021 by first inserting the gallery insert, and then rotating it between an insertion position and an anti-rotation position. All of the followers 10 aligned with the oil gallery can have simultaneous prevention of rotation with respect to the ram rail.

Looking at an alternative section view along follower axis R in FIG. 2C, an additional advantage can be seen. The flat surface 502 removes material from the follower 10, which lightens the follower 10. But what also happens, and comparing FIGS. 2B & 2C, is that the followers 10 encroach in to the space for oil gallery 602. The bore 110 contacts the oil gallery bore 6021, and overlaps the oil gallery bore 6021 in an axis parallel to follower axis R. The size of the oil gallery bore 6021 can be reduced. So, the followers can be placed closer to the oil gallery 602. This permits a more compact engine design over-all, which saves material and improves the overall weight characteristics of the device. Reducing vehicle weight improves vehicle fuel economy.

Other implementations will be apparent to those skilled in the art from consideration of the specification and practice of the examples disclosed herein.

What is claimed is:

1. An engine block, comprising:

a cam rail comprising a rotating eccentric cam extending along a cam rail axis Q;

a plurality of followers, each follower of the plurality of followers comprising:

a first end in contact with the rotating eccentric cam;

a second end configured to contact with a portion of a valve train mechanism configured to open and close a fluid pathway of a combustion cylinder;

a body extending between the first end and the second end along a follower axis R, the follower axis R being perpendicular to cam rail axis Q, the body comprising a flat surface bounded by a first sealing land and a second sealing land; and a fluid port;

an oil gallery bore parallel to the cam rail along an oil gallery axis P, the oil gallery bore comprising an internal surface, the oil gallery bore configured to supply fluid to each follower fluid port of the plurality of followers; and a gallery insert in the oil gallery bore, the gallery insert comprising a sheet or tube shape configured to abut the follower body of each of the plurality of followers to prevent rotation of each of the followers with respect to the cam rail, the gallery insert extending along the oil gallery bore parallel to the oil gallery axis P, the gallery insert comprising:

a first end that extends out from the oil gallery bore to abut the flat surface of each of the plurality of followers; and a second end that either extends out from the oil gallery bore to abut the flat surface of each of the plurality of followers or a second end that abuts the internal surface of the oil gallery bore.

2. The engine block of claim 1, comprising a plurality of follower bores in contact with the oil gallery bore, wherein each of the followers of the plurality of followers are seated in respective ones of the plurality of follower bores, and each of the followers of the plurality of followers comprises:

a body comprising an exterior configured for sliding in the follower bore;

an interior axial pocket comprising a biased plunger, a check ball mechanism, and a fluid reservoir; and a fluid port passing through the body from the exterior to the interior, the fluid port configured to align with the oil gallery bore.

3. The engine block of claim 2, wherein each of the followers of the plurality of followers further comprises a roller rotatably mounted on the first end, the roller configured for rolling contact with the rotating eccentric cam.

4. The engine block of claim 1, wherein the gallery insert is a C-shaped structure.

5. The engine block of claim 4, wherein the internal surface of the oil gallery bore comprises a C-shaped recess for receiving a peripheral surface area of the C-shaped structure.

6. The engine block of claim 1, wherein the gallery insert is a triangular tube structure comprising a first edge, a second edge, and a third edge, wherein the first edge abuts each follower of the plurality of followers to prevent rotation, and wherein the second edge and the third edge abut the internal surface of the oil gallery bore.

7. The engine block in claim 1, wherein the gallery insert is a rectangular sheet structure.

8. The engine block of claim 1, wherein the gallery insert is a perforated structure configured to slide through the oil gallery bore.

9. The engine block of claim 8, wherein the perforated structure comprises perforations spaced at each follower fluid port of the plurality of followers and the perforations oriented and sized to manage oil fed to the fluid port.

10. The engine block of claim 1, further comprising a keyed cap, wherein the oil gallery bore comprises an orientation key hole, and wherein the keyed cap interfaces with the gallery insert and the orientation key hole to fix the orientation of the gallery insert with respect to the oil gallery bore.

11. The engine block of claim 1, wherein the gallery insert comprises a keyed structure at one end, wherein the oil gallery bore comprises a keyed notch, and wherein the keyed structure seats in the keyed notch to orient the gallery insert.

12. The engine block of claim 1, wherein the gallery insert is rotatable inside the oil gallery bore between an insertion position and an anti-rotation position.

13. The engine block of claim 1, wherein each follower body of the plurality of followers comprises a flat surface adjacent to the oil gallery bore.

14. An engine block, comprising:

a cam rail comprising a rotating eccentric cam;

a follower, comprising:

a first end in contact with the rotating eccentric cam;

a second end configured to contact with a portion of a valve train mechanism configured to open and close a fluid pathway of a combustion cylinder;

a body extending between the first end and the second end; and a fluid port;

an oil gallery bore parallel to the cam rail, the oil gallery bore configured to supply fluid to the follower fluid port; and a gallery insert along the oil gallery bore parallel to the cam rail, the gallery insert configured to abut the follower body to prevent rotation of the follower with respect to the cam rail, wherein the gallery insert is rotatable inside the oil gallery bore between an insertion position and an anti-rotation position, the insertion position permitting rotation of the follower and the anti-rotation position configured to prevent rotation of the follower.

15. An engine block, comprising:

a cam rail comprising a rotating eccentric cam;

a follower, comprising:

a first end in contact with the rotating eccentric cam;

a second end configured to contact with a portion of a valve train mechanism configured to open and close a fluid pathway of a combustion cylinder;

a body extending between the first end and the second end; and a fluid port;

an oil gallery bore parallel to the cam rail, the oil gallery bore configured to supply fluid to the follower fluid port; and a perforated gallery insert extending in the oil gallery bore, the perforated gallery insert configured to abut the follower body to prevent rotation of the follower with respect to the cam rail.

16. The engine block of claim 15, wherein the gallery insert is along the oil gallery bore parallel to the cam rail.

17. An engine block, comprising:

a cam rail comprising a rotating eccentric cam;

a follower, comprising:

a first end in contact with the rotating eccentric cam;

a second end configured to contact with a portion of a valve train mechanism configured to open and close a fluid pathway of a combustion cylinder;

a body extending between the first end and the second end; and a fluid port;

an oil gallery bore parallel to the cam rail, the oil gallery bore configured to supply fluid to the follower fluid port; and a gallery insert in the oil gallery bore, the gallery insert configured to abut the follower body to prevent rotation of the follower with respect to the cam rail, wherein the gallery insert comprises a keyed structure at one end, wherein the oil gallery bore comprises a keyed notch, and wherein the keyed structure seats in the keyed notch to orient the gallery insert.

* * * * *